US005370336A

United States Patent [19]

Whittington

[11] Patent Number: 5,370,336

[45] Date of Patent: Dec. 6, 1994

[54] DISPENSER APPARATUS FOR SEQUENTIALLY DISPENSING FROM CORELESS ROLLS OF SHEET MATERIAL

[75] Inventor: Jimmie L. Whittington, Diamond Bar, Calif.

[73] Assignee: James River Paper Company, Inc., Richmond, Va.

[21] Appl. No.: 71,238

[22] Filed: Jun. 4, 1993

[51] Int. Cl.[5] ..... B65H 19/10

[52] U.S. Cl. ..... 242/560.2; 242/599.4

[58] Field of Search ..... 242/55.3, 55.42, 55.53, 242/560.2, 560.3, 563.2, 596.7, 597.6, 599.4; 312/34.22, 34.24, 34.8

[56] References Cited

U.S. PATENT DOCUMENTS

| | | | |
|---|---|---|---|
| 3,211,504 | 10/1965 | Bump | 312/39 |
| 3,387,902 | 6/1968 | Perrin et al. | 312/39 |
| 3,523,653 | 8/1970 | Hansen | 242/55.53 |
| 3,770,222 | 11/1973 | Jespersen | 242/55.3 |
| 3,771,739 | 11/1973 | Nelson | 242/55.3 |
| 4,071,200 | 1/1978 | Stone | 242/55.2 |
| 4,143,827 | 3/1979 | Tucker | 242/55.3 |
| 4,340,195 | 7/1982 | DeLuca | 242/55.3 |
| 4,497,453 | 2/1985 | Butcher | 242/55.53 |

*Primary Examiner*—Daniel P. Stodola
*Assistant Examiner*—John Q. Nguyen
*Attorney, Agent, or Firm*—Thomas R. Lampe

[57] ABSTRACT

Dispenser apparatus for sequentially dispensing web material from a plurality of coreless rolls includes a support with a housing having a dispensing opening. A coreless roll holder is slidably positioned in channels formed in the support and includes a frame and coreless roll support shafts connected to the frame at spaced locations, each coreless roll support shaft for insertion into a central aperture of a coreless roll for supporting the coreless roll. The coreless roll holder moves between alternate locations relative to the support to provide selective manual access to the coreless rolls for dispensing. A lock retains the coreless roll holder in one of the locations until a coreless roll is depleted from one of the coreless roll support shafts and the coreless roll holder will automatically move to the second location under the influence of gravity.

12 Claims, 5 Drawing Sheets

DISPENSER APPARATUS FOR SEQUENTIALLY DISPENSING FROM CORELESS ROLLS OF SHEET MATERIAL

TECHNICAL FIELD

This invention relates to the dispensing of sheet material from a coreless roll product such as a coreless roll of paper tissue. More particularly, the apparatus of the present invention relates to a dispenser for dispensing web material sequentially from a plurality of coreless rolls of said web material, each coreless roll comprised of a plurality of wound convolutions of the web material and having a central aperture defined by an innermost convolution.

BACKGROUND ART

A conventional toilet tissue roll is comprised of a core made of paperboard or the like about which are wound convolutions of the tissue. The rolls are typically dispensed by unwinding the tissue until the tissue is depleted and the core remains to be discarded.

It is also known to provide coreless tissue and other paper products wherein the product is wound directly onto a mandrel and not onto a permanent core when being formed. The finished product, in other words, has no core and nothing is left to discard once the roll has been unwound and used by a consumer.

A wide variety of dispensers have been devised over the years for dispensing tissue from rolls, principally rolls having cores. The prior art dispensers can dispense from either single or multiple rolls and arrangements are known for allowing for the sequential dispensing of tissue and the like from multiple rolls. Insofar as multiple roll dispensing is concerned, it is known to employ a cabinet having a dispensing opening and incorporating a mechanism which will present rolls for dispensing automatically or semiautomatically in response to depletion of one of the rolls. Most such mechanisms are specifically for use with rolls having cores.

U.S. Pat. No. 3,387,902, issued Jun. 11, 1968, discloses a dispenser for sequentially presenting rolls of tissue and the like for dispensing purposes, the rolls having cores which are split into segments. The rolls are mounted on roll holders projecting from a frame. The frame is slidably mounted in a housing. Depletion of a roll will result in actuation of a mechanism which will cause the frame to slide relative to the housing and present another tissue roll having a split core in a dispensing position.

The arrangement disclosed in U.S. Pat. No. 3,387,902 is inappropriate for use with coreless tissue rolls. For example, the roll holder structure disclosed in U.S. Pat. No. 3,387,902 will not and cannot fit within the confines of a coreless tissue roll central aperture which typically is quite constricted in nature.

A search of the prior art also located the following United States patents relating to dispensing from single or multiple rolls of paper tissue and the like: U.S. Pat. No. 4,497,453, issued Feb. 5, 1985, U.S. Pat. No. 3,771,739, issued Nov. 13, 1973, U.S. Pat. No. 4,340,195, issued Jul. 20, 1982, U.S. Pat. No. 3,770,222, issued Nov. 6, 1973, U.S. Pat. No. 4,143,827, issued Mar. 13, 1979, U.S. Pat. No. 3,523,653, issued Aug. 11, 1970, U.S. Pat. No. 4,071,200, issued Jan. 31, 1978, and U.S. Pat. No. 3,211,504, issued Oct. 12, 1965. Those arrangements which allow sequential dispensing from multiple rolls are for the most part inapplicable and inappropriate insofar as dispensing from coreless rolls is concerned.

DISCLOSURE OF INVENTION

The present invention relates to a dispenser apparatus of relatively simple and inexpensive construction which reliably provides for the sequential dispensing of web material such as paper tissue from a plurality of coreless rolls thereof. Each coreless roll is comprised of a plurality of wound convolutions of the web material and has a central aperture defined by an innermost convolution.

The dispenser apparatus incorporates a support including a housing having a dispensing opening. The apparatus also incorporates coreless roll holder means including a frame, a first coreless roll support shaft connected to the frame at a first position on the frame, and a second coreless roll support shaft connect to the frame at a second position on the frame spaced from the first position. Each coreless roll support shaft is for insertion into a central aperture of a coreless roll for supporting a coreless roll thereon.

Mounting means is operatively associated with the support and the coreless roll holder means for alternatively locating the coreless roll holder means at either a first location wherein the first coreless roll support shaft is located for dispensing through the dispensing opening and the second coreless roll support shaft is located for non-dispensing and a second location wherein the second coreless roll support shaft is located for dispensing through the dispensing opening.

Locking means is provided for retaining the coreless roll holder means at the first location until substantial depletion of a coreless roll on the first coreless roll support shaft. The locking means is responsive to substantial depletion of a coreless roll on the first coreless roll support shaft to release the coreless roll holder means and allow movement of the coreless roll holder means to the second location under the influence of gravity to allow manual access at the dispensing opening to a coreless roll on the second coreless roll support shaft.

The locking means includes a lock element operatively associated with at least one of the coreless roll support shafts and moveable relative thereto between a lock position wherein the lock element engages the support and locks the coreless roll holder means against movement from the first location to the second location and an unlock position wherein the lock element permits movement of the coreless roll holder means under the influence of gravity to the second location from the first location.

Other features, advantages, and objects of the present invention will become apparent with reference to the following description and accompanying drawings.

BEST MODE FOR CARRYING OUT THE INVENTION

Figure 1:
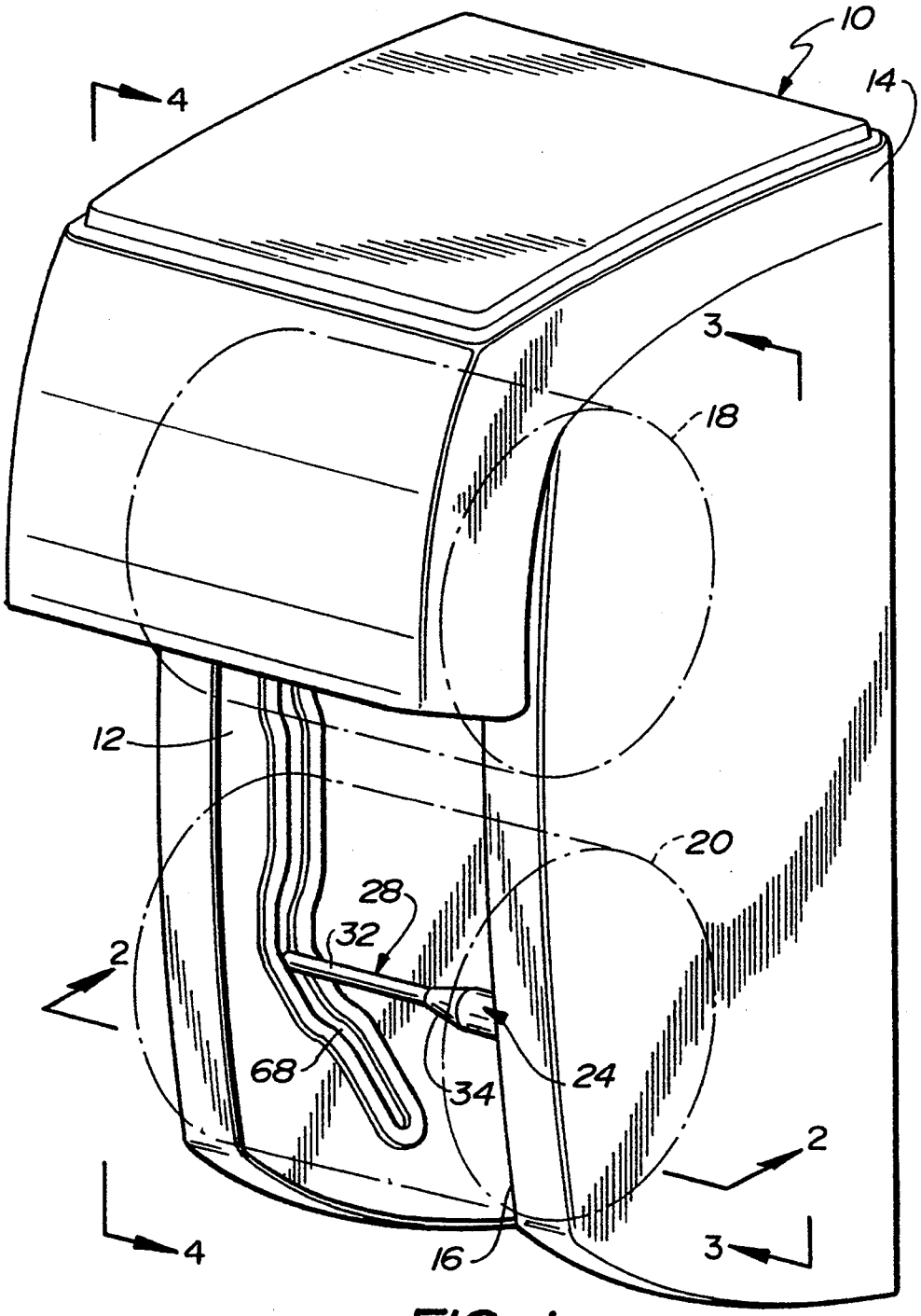
FIG. 1 is a perspective view of apparatus constructed in accordance with the teachings of the present invention and illustrating in phantom the relative locations of two coreless rolls of toilet tissue for dispensing from the apparatus.

Referring to the drawings, dispenser apparatus constructed in accordance with the teachings of the present invention includes a support including housing 10 having opposed side walls 12, 14. A dispensing opening 16 is formed at the front of the housing or cabinet at the lower front thereof. FIG. 1 illustrates in phantom line two coreless tissue rolls 18, 20. Tissue roll 20 is the lowermost roll and is in dispensing position, partially projecting through opening 16 so that manual access thereto may be had by a consumer wishing to unwind tissue therefrom.

A coreless roll holder 24 is mounted within housing 10. Coreless roll holder 24 includes a frame 26. A first coreless roll support shaft 28 is attached to the frame at one end thereof and projects across the housing 10. A second coreless roll support shaft 30 is connected to the frame at a second location thereon spaced from the first location. It will be noted that the second coreless roll support shaft 30 is located above the first coreless roll support shaft 28 when tissue rolls 18, 20 are in place.

The coreless roll support shafts 28, 30 are of identical construction. Each coreless roll support shaft includes an elongated spindle 32 and a mandrel 34 slidably mounted on the spindle.

Spindle 32 includes an arbor 36 connected to the rest of the spindle where the spindle is attached to frame 26. A knob 40 is disposed in alignment with the spindle 32 on the other side of frame 26 and, as will be discussed later, is employed to guide and position the frame relative to the housing. If desired, the knob 40 may be utilized to secure the coreless roll support shaft to the frame 26. For example, the knob may threadedly engage an end of the spindle projecting through the frame.

Each mandrel 34 includes a mandrel body 42 defining a recess 44 at the end of arbor 36. Recess 44 accommodates therein a coil compression spring 48 which, when compressed, urges the mandrel 34 to the left as viewed in FIGS. 2 and 2A.

Figure 2:
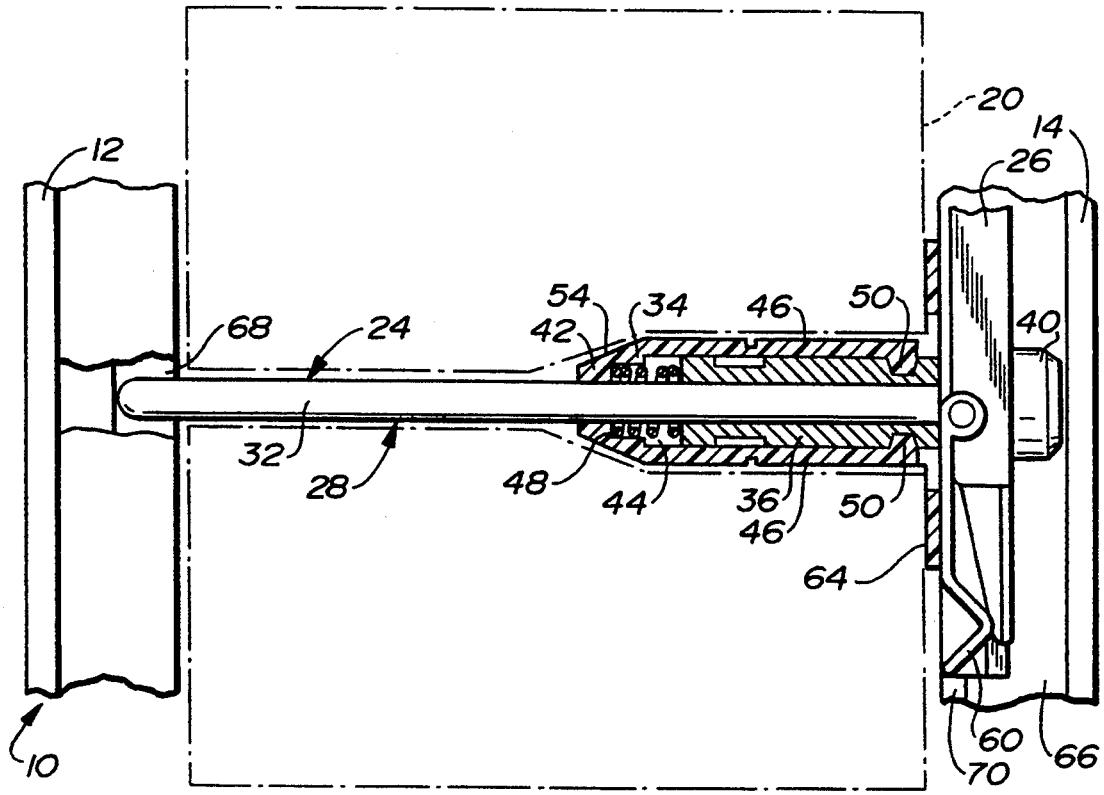
FIG. 2 is an enlarged, cross-sectional view illustrating a portion of the apparatus as taken along the line 2—2 in FIG. 1 with the illustrated structural components in the relative positions assumed thereby when holding a coreless tissue roll.
Figure 2A:
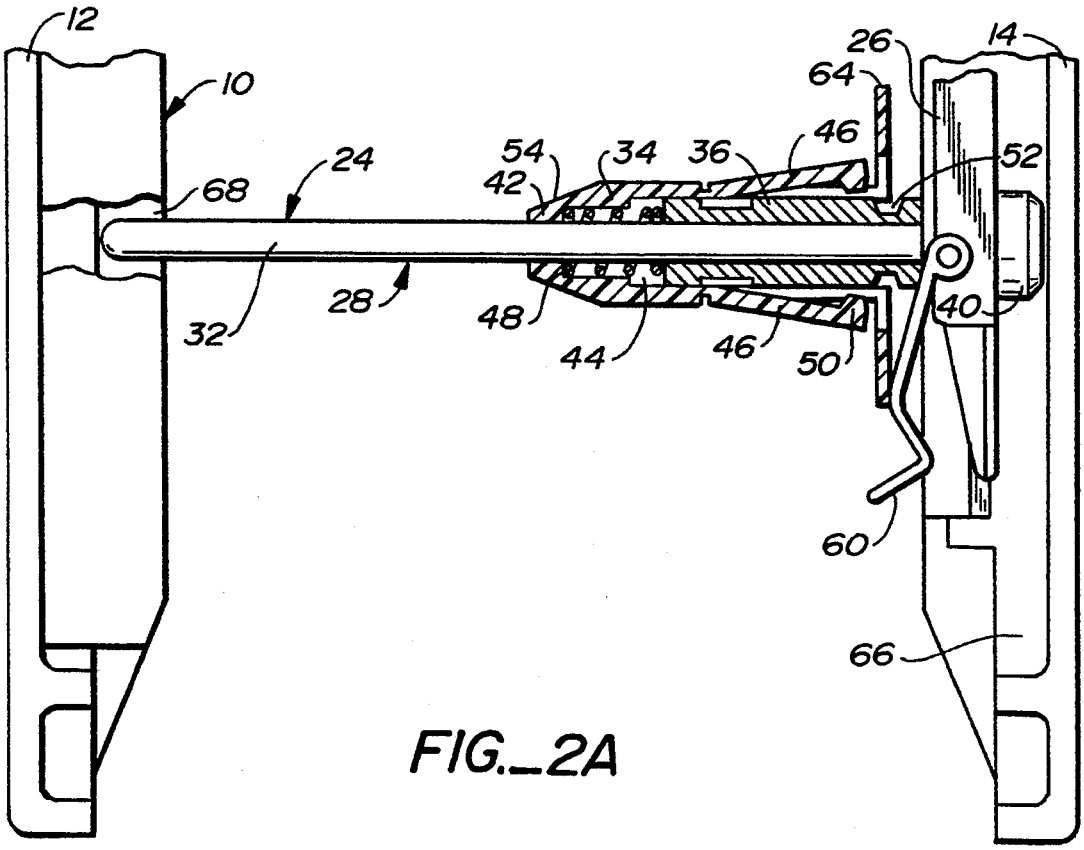
FIG. 2A is a view similar to FIG. 2 but illustrating the structural components in the relative positions assumed thereby after depletion of a coreless tissue roll.

Each mandrel 34 also includes a pair of locking arms 46 which normally occupy the positions shown in FIG. 2A in the absence of outside forces being applied thereto. The locking arms, however, may be flexed about their location of interconnection with the mandrel body 42 and flattened against the arbor 36 as shown in FIG. 2.

Each locking arm 46 has a detent 50 at the distal end thereof. The arbor 36 has indents 52 formed therein which will accommodate detents 50 when the detents and indents are in registration (as shown in FIG. 2) and inwardly directed forces are applied to the free or distal ends of the locking arms.

Movement of the mandrel from the position shown in FIG. 2A to the position shown in FIG. 2 is effected by sliding a coreless roll of paper tissue over the spindle 32 and mandrel 34. As will be seen below, this is accomplished when the coreless roll holder 24 is removed in its entirety from the housing 10.

As the roll is pushed into position, the paper compresses and the central aperture of the roll assumes the shape of the mandrel. The aperture at the right end of the roll thus has a circumference generally corresponding to the outer circumference of the mandrel body 42. The left most end of the mandrel body 42, as viewed in FIG. 2 and FIG. 2A, has a tapered surface designated by reference numeral 54. Movement of the coreless paper roll to the right on the coreless roll support shaft will force the mandrel 34 to the right to the position shown in FIG. 2. Of course, the coreless roll will also force the locking arms 46 to the positions shown in FIG. 2 and cause the detents 50 to enter into indents 52 and remain therein under the constant urging of the inwardly directed pressure exerted by the roll convolutions.

Pivotally attached to the frame 26 closely adjacent to each coreless roll support shaft is a lock element 60. In the absence of outside forces being applied thereto, the lock element is free to assume the position illustrated in FIG. 2A. When, however, a roll is slid on the coreless roll support shaft operatively associated therewith, the mandrel 34 thereof will engage the lock element 60 and urge it to the position shown in FIG. 2. In particular, the mandrel body of the mandrel includes a flange 64 radiating outwardly from the spindle which engages the lock element and moves it to the position shown in FIG. 2 when a coreless roll is installed.

In common with the dispenser disclosed in U.S. Pat. No. 3,387,802, referenced above, the coreless roll holder 24 of the present invention can be removed in its entirety from support 10. A channel 66 is formed in side wall 14 of the housing. Channel 66 is open at the top thereof so that the coreless roll holder 24 receives elements of the frame 26, more particularly in the disclosed embodiment the frame knobs 40 which cooperate with the channel to guide placement and movement of the frame relative to the housing.

Side wall 12 has a channel 68 therein which receives the distal ends of spindles 32 of the coreless roll support shafts 28, 30. The configuration of the two channels is essentially the same except that channel 68 is considerably narrower than channel 66 to conform to the size of the spindle distal ends.

Figure 3:
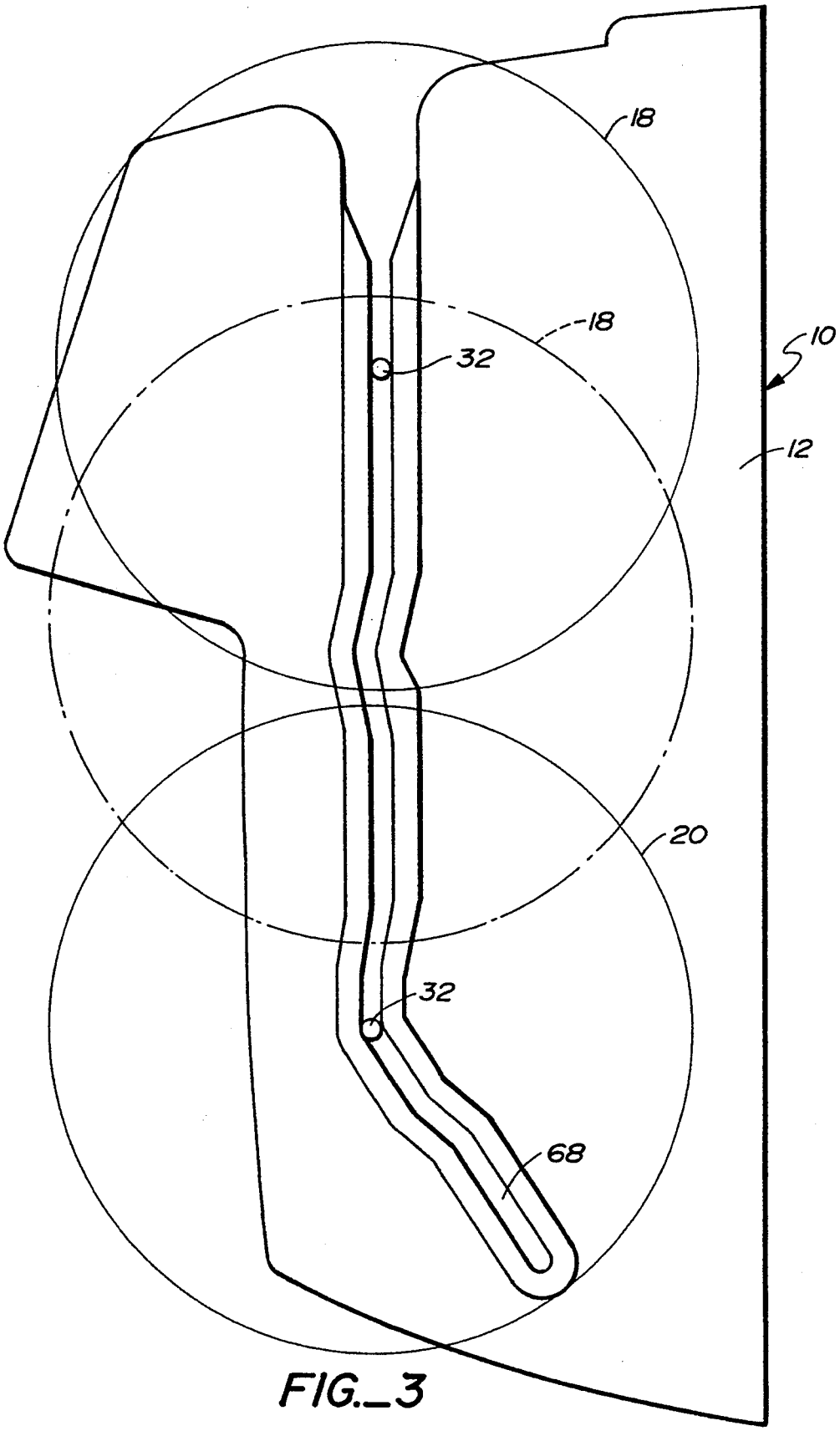
FIG. 3 is an enlarged, somewhat diagrammatic view of a housing side wall and related structure as taken in the direction of line 3—3 in FIG. 1.
Figure 4:
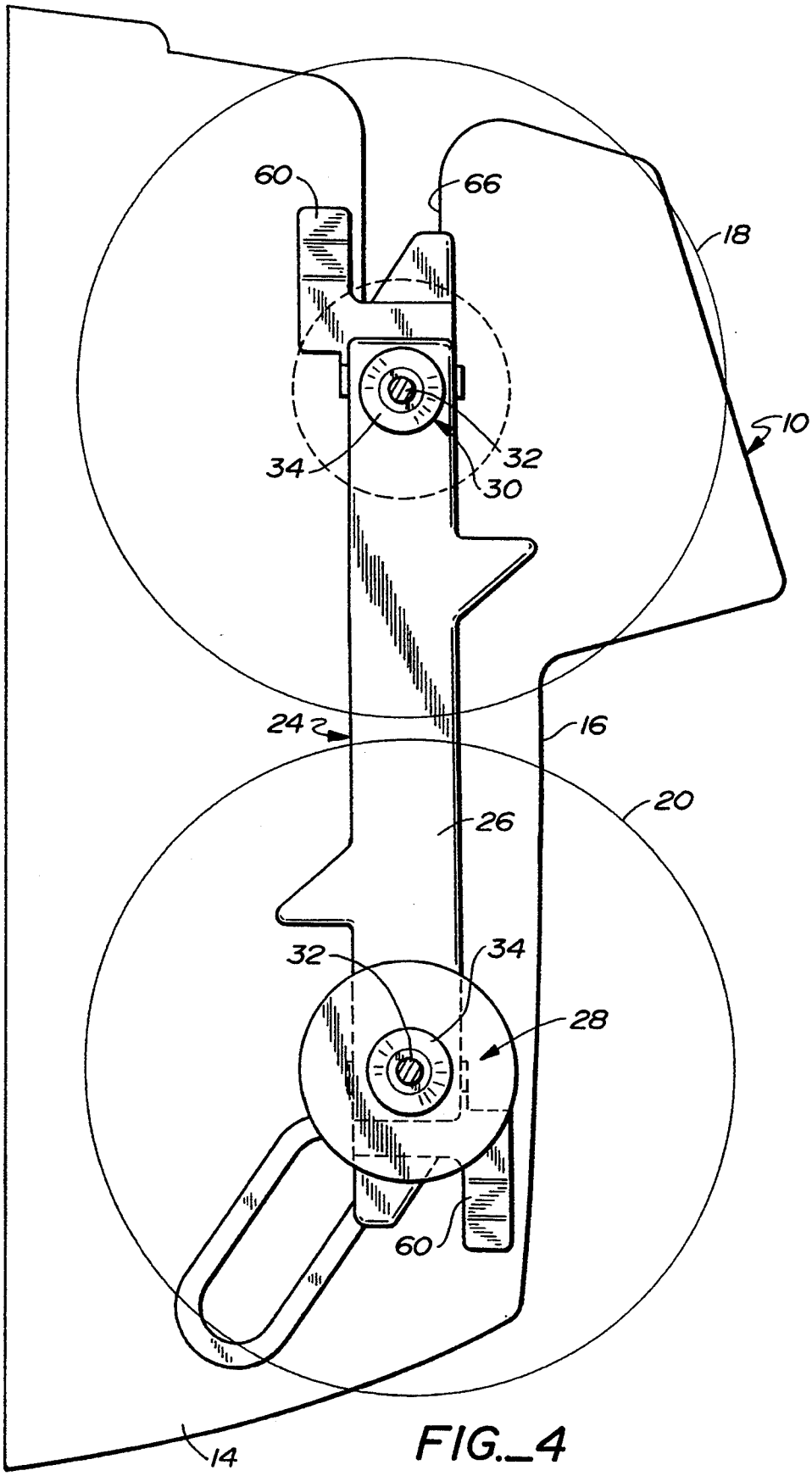
FIG. 4 is an enlarged, somewhat diagrammatic view taken in the direction of line 4—4 in FIG. 1 and illustrating the relative positions assumed between the apparatus support and coreless roll holder operatively associated therewith when both coreless roll support shafts support a coreless roll.

In use, coreless rolls are slid over both of the coreless roll support shafts. This, of course, results in inward displacement of the mandrels 34 as previously described and the consequent movement of lock element 60 to the position shown in FIG. 2. The attendant then lowers the entire coreless roll holder 24 into channels 66, 68, with free sliding between the coreless roll holder and housing taking place until the lock element 60 operatively associated with the lowest coreless roll support shaft (coreless roll support shaft 28 in the drawings) engages an abutment 70 on support 10 at the channel 66. Engagement between the lock element 60 and the abutment will terminate further downward movement of the coreless roll holder and the rolls and holder will assume the positions within the housing shown in FIGS. 3 and 4. At this location, tissue roll 20 will be positioned at the dispensing opening 16 for ready access to roll 20 by a user.

When tissue roll 20 becomes substantially depleted, the locking arms 46 of the mandrel 34 of the first coreless roll support shaft 28 will flex outwardly and assume the positions shown in FIG. 2A. This allows the spring 48 to move the mandrel away from frame 26 and the associated lock element 60, also as shown in FIG. 2A.

Figure 4A:
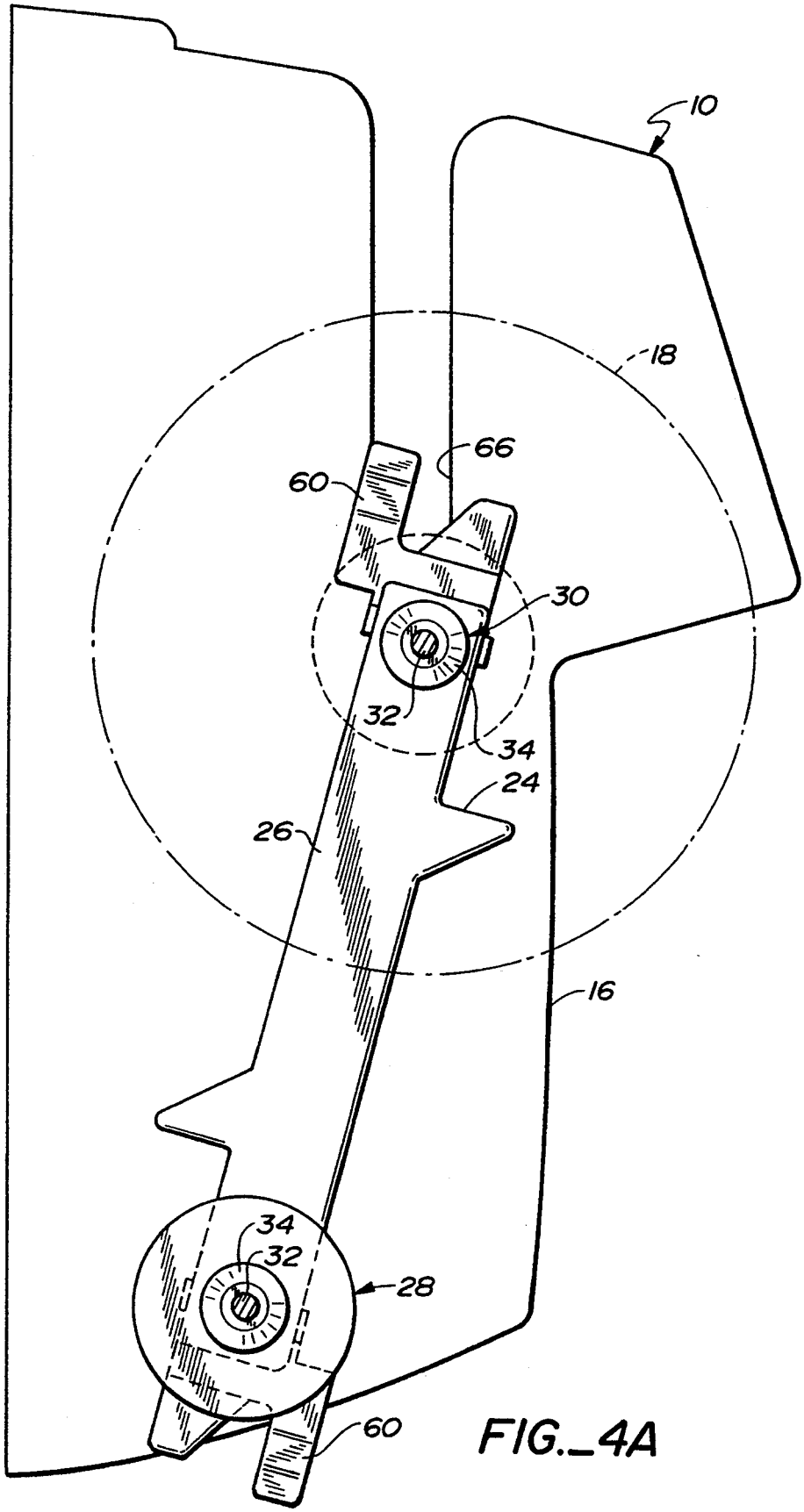
FIG. 4A is a view similar to FIG. 4, but illustrating the relative positions assumed between the support and the coreless roll holder after depletion of the lowermost roll.

The lowermost lock element 60 will then be biased outwardly by abutment 70 due to the weight of the holder and upper roll. The lock element clears the abutment and moves to the position shown in FIG. 2A, thus allowing the entire coreless roll holder 24 to proceed downwardly within the housing 10 under the influence of gravity so that the coreless roll holder 24 will move to the position shown in FIG. 4A. It will be noted that the coreless roll holder has not only moved downwardly but has assumed a tilted attitude with respect to the housing 10. This places the upper coreless roll, tissue roll 18, at a position where it extends outwardly through dispensing opening 16 and can be readily manually accessed. Downward movement of the entire coreless roll holder 24 is terminated at the location shown in FIG. 4A due to the fact that the bottom of channel 66 has been reached.

As is the case with respect to the arrangement shown in above referenced U.S. Pat. No. 3,387,902, the coreless roll holder 24 may be removed by an operator from the housing and inverted so that what was formerly the topmost coreless roll support shaft becomes the lowermost coreless roll support shaft and visa versa. Thus, the lock elements 60 operatively associated with the frame 26 extend outwardly in opposition to one another and are disposed on opposed sides of the frame.

I claim:

1. Dispenser apparatus for sequentially dispensing web material from a plurality of coreless rolls of said web material, each said coreless roll comprised of a plurality of wound convolutions of said web material and having a central aperture defined by an innermost convolution, said apparatus comprising, in combination:

a support including a housing having a dispensing opening;

coreless roll holder means for holding a coreless roll, said coreless roll holder means including a frame, a first coreless roll support shaft connected to said frame at a first position on said frame, and a second coreless roll support shaft connected to said frame at a second position on said frame spaced from said first position, each said coreless roll support shaft for insertion into a central aperture of a coreless roll for supporting a coreless roll thereon;

mounting means operatively associated with said support and said coreless roll holder means for alternatively locating said coreless roll holder means at either a first location wherein said first coreless roll support shaft is located for dispensing at said dispensing opening and said second coreless roll support shaft is not located at said dispensing opening and a second location wherein said second coreless roll support shaft is located for dispensing at said dispensing opening;

locking means for retaining said coreless roll holder means at said first location until depletion of a coreless roll on said first coreless roll support shaft and responsive to depletion of a coreless roll on said first coreless roll support shaft to release said coreless roll holder means and allow movement of said coreless roll holder means to said second location under the influence of gravity to allow manual access at said dispensing opening to a coreless roll on said second coreless roll support shaft, said locking means including a lock element operatively associated with at least one of said coreless roll support shafts and movable relative thereto between a lock position wherein said lock element engages said support and locks said coreless roll holder means against movement from said first location to said second location and an unlock position wherein said lock element disengages from said support and permits movement of said coreless roll holder means under the influence of gravity to said second location from said first location, said lock element mounted for pivotal movement; and biasing means biasing said lock element toward said unlock position, said at least one of said coreless roll support shafts including a spindle and a mandrel slidably mounted on said spindle and engageable with said lock element when said coreless roll support shaft is positioned in the central aperture of a coreless roll to maintain said lock element in said lock position.

2. The apparatus according to claim 1 additionally comprising mandrel locking means engageable by a coreless roll mounted on said spindle and mandrel for locking said mandrel against slidable movement on said spindle in a direction away from said lock element.

3. The apparatus according to claim 2 wherein said mandrel includes a mandrel body and at least one locking arm having a detent, said locking arm comprising said mandrel locking means and being affixed to said mandrel body and moveable relative thereto, said spindle including an indent for accommodating said detent when said spindle and mandrel are positioned in the central aperture of a coreless roll.

4. The apparatus according to claim 3 wherein said spindle includes an arbor, at least a portion of said arbor forming said indent.

5. The apparatus according to claim 3 wherein said at least one locking arm is biased to move said detent away from said indent in the absence of outside forces being applied to said at least one locking arm.

6. The apparatus according to claim 3 wherein a plurality of locking arms are affixed to said mandrel body.

7. The apparatus according to claim 3 wherein said mandrel body includes a flange extending radially outwardly away from said spindle and engageable with said lock element.

8. The apparatus according to claim 2 additionally comprising biasing means biasing said mandrel in a direction away from said lock element.

9. The apparatus according to claim 1 wherein said support includes an abutment, said lock element being mounted on said frame and engaging said abutment to lock said coreless roll holder means against movement from said first location to said second location.

10. The apparatus according to claim 1 wherein a lock element is operatively associated with each of said coreless roll support shafts.

11. The apparatus according to claim 1 wherein each of said coreless roll support shafts includes a spindle and a mandrel slidably mounted on said spindle and engageable with said lock element, said frame being selectively manually positionable relative to said support to reverse the position of said coreless roll holder means relative to said support.

12. The apparatus according to claim 1 wherein each of said coreless roll support shafts has a distal end, said housing having two opposed side walls, each of said opposed side walls defining a channel, one of said channels slidably receiving a portion of said frame and one of said channels slidably receiving said coreless roll support shaft distal ends.

* * * * *